United States Patent [19]

Boucraut

[11] 4,231,563

[45] Nov. 4, 1980

[54] DEVICE FOR GRIPPING AND DISPLACING KNITTED OR WOVEN ARTICLES

[75] Inventor: Frantz M. Boucraut, Troyes, France

[73] Assignee: Valton S.A., Troyes, France

[21] Appl. No.: 955,413

[22] Filed: Oct. 27, 1978

[30] Foreign Application Priority Data

Nov. 4, 1977 [FR] France ..... 77 33192
Oct. 11, 1978 [FR] France ..... 78 28994

[51] Int. Cl.[3] ..... B65H 3/22
[52] U.S. Cl. ..... 271/18.3; 271/98; 271/105
[58] Field of Search ..... 271/10, 11, 18.3, 98, 271/105, 112, 97, 90

[56] References Cited

U.S. PATENT DOCUMENTS 3,806,114 4/1974 Carter ..... 271/98 X
4,157,824 6/1979 Littlewood ..... 271/18.3 X

*Primary Examiner*—Richard A. Schacher
*Attorney, Agent, or Firm*—Gerald J. Ferguson, Jr.; Joseph J. Baker

[57] ABSTRACT

The invention relates to a device for taking up and displacing knitted or woven articles which are disposed in a pile, both when folded and not folded. The device is a combination of a first needle type gripping means with a vacuum gripping means and a supplying means. The needle type gripping means raises an edge of an article in the pile and, during a relative movement occurring between the vacuum gripping means and the supplying means, the latter progressively conveys this article towards the vacuum gripping means until said article adheres thereto as a result of a vacuum effect.

11 Claims, 10 Drawing Figures

A
B
C
C'
F
J
T
T1
T2
L1
L2
1
2
6
16
18'
26
37
38

DEVICE FOR GRIPPING AND DISPLACING KNITTED OR WOVEN ARTICLES

BACKGROUND OF THE INVENTION

1. Field of the Invention

The present invention relates to a device serving to take from a pile a knitted or woven article, to displace the article thus taken and to place it at a pre-arranged place.

2. Description of the Prior Art

Devices of this type are already known, particularly by virtue of French Pat. Nos. 2 011 087 and 2 132 573, which describe a device including one or more gripping means each constituted by a retractible, oblique needle that can be displaced along a rectilinear path. When each needle is pushed so as to project, it penetrates the thickness of the article to be selected by an amount sufficient to lift this article when the device as a whole is itself raised.

Although it is possible to use on one and the same device several needle type gripping means disposed in diverging or even opposed directions, for example from the centre to the outside of the article to be displaced, satisfactory results are not obtained when the knitted articles reach any considerable size. In this case, the weight of the article causes it to droop considerably between the gripping points and it may even become detached during lifting. Even if the weight is not sufficient to cause it to become detached, the drooping portions hinder displacement and are prejudicial to precise positioning of the article transported.

In order to remedy the above drawbacks, it has been proposed to use the combined action of a needle type gripping means and of a vacuum type gripping means. Different forms of embodiment of a combination of this type are disclosed in the following patents: French Pat. Nos. 85 309 (certificate of addition)-2 011 072 (certificate of addition)-2 104 132-2 109 407 (certificate of addition) 2 041 874- and U.S. Pat. No. 3,386,396.

SUMMARY OF THE INVENTION

The present invention is not a combination of two gripping means but a combination of three means which include a needle type gripping means, a vacuum type gripping means and a third means co-operating with the first two means.

The main object of the invention is to provide a device with three members acting in a combination that is capable of taking from a pile a knitted or woven article the size of which may be very large, and obviating any risk of gripping two articles that are placed on top of one another or of disturbing the uppermost articles on the pile.

A secondary object of the invention is to provide a device with three members as described above, said device being capable of gripping knitted or woven articles, that are piled in a folded condition, one by one, of unfolding each article completely, of lifting it and of displacing it without disturbing the following articles in the pile.

The objects of the invention are attained by means of a gripping device including at least one needle type gripping means combined, on one hand, with a vacuum gripping means provided with an adherence surface and, on the other hand, with a supplying means, said supplying means being placed substantially at the height of a first article of a pile, at least one of the two means, namely the vacuum gripping means and the supplying means, being mounted so as to provide for relative movement between these two means beginning with the approach of one towards the other when the needle type gripping means has seized and raised the edge, adjacent to the supplying means, of the first article lying on the pile of articles.

According to a first embodiment of the invention, the supplying means is mobile and its displacement, at the desired moment, provides the relative movement mentioned above.

According to a second embodiment of the invention, the supplying means is fixed and the relative movement mentioned above results from the movement of the vacuum gripping means.

The supplying means operates when the needle type gripping means has raised one end of a knitted article, while this means holds this end in a raised position and while the vacuum gripping means is brought into operation. The combined action of these three means causes the first knitted article at the top of a pile of identical articles alone to be raised and brought progressively closer over its entire length to the suction zone of the vacuum gripping means. This article is thus seized by the latter means in a precise and repetitive manner in such a way that the articles displaced can be displaced and then deposited with the same degree of accuracy, for example for the purpose of feeding a sewing machine.

When the pile is composed of folded articles, each folded article has an upper panel and a lower panel; the one or more needle type gripping means seize the edge of the upper panel and lift it. The relative movement of the vacuum gripping means in relation to the supplying means causes the folded article to unfold; said article opens out completely and its entire surface adheres to the adherence surface of the vacuum gripping means.

DETAILED DESCRIPTION OF THE INVENTION

A device according to the invention includes the combination of three members which are each known per se in their non-combined state. There is thus no need to provide a detailed description of these members.

Figure 1:
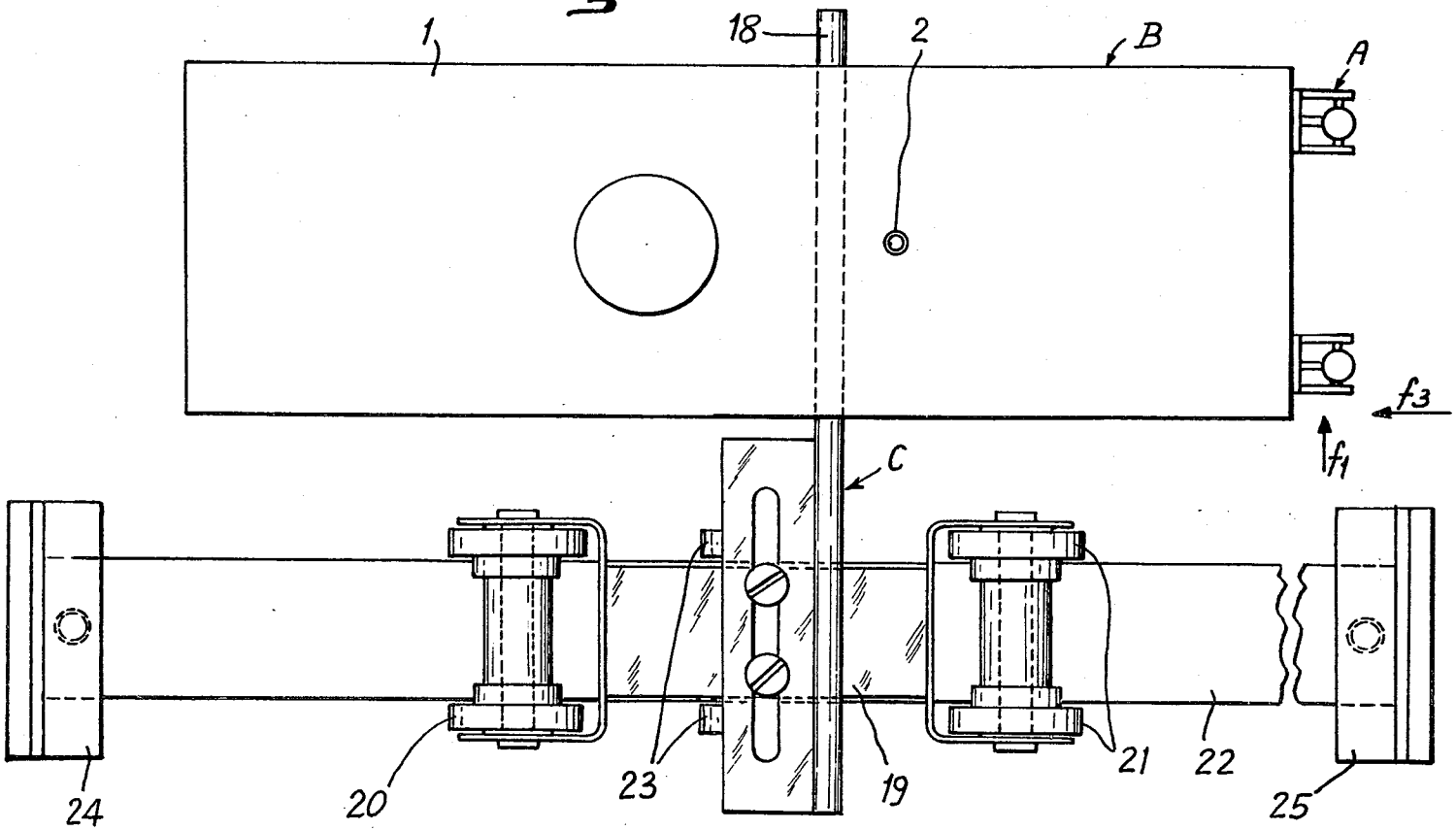
FIG. 1 is a top view of a device according to the invention, according to the first embodiment thereof.
Figure 4:
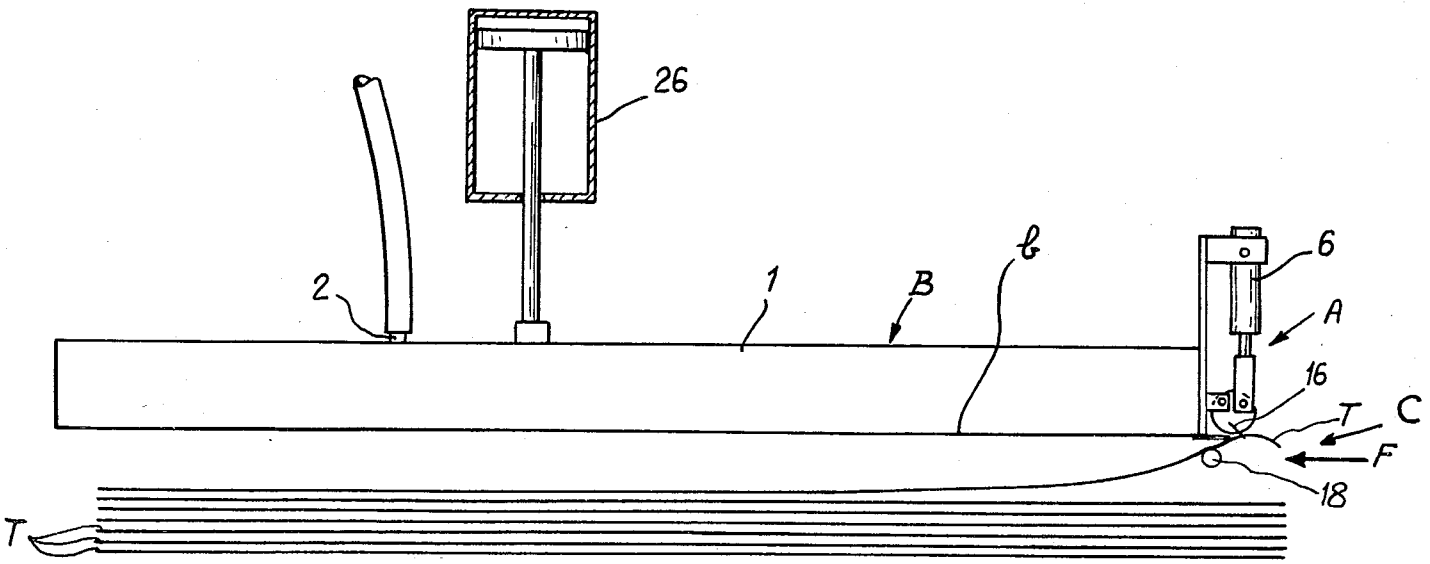
FIG. 4 is a side view of the device of FIG. 1, with certain members omitted, serving to illustrate its principle of operation.
Figure 9:
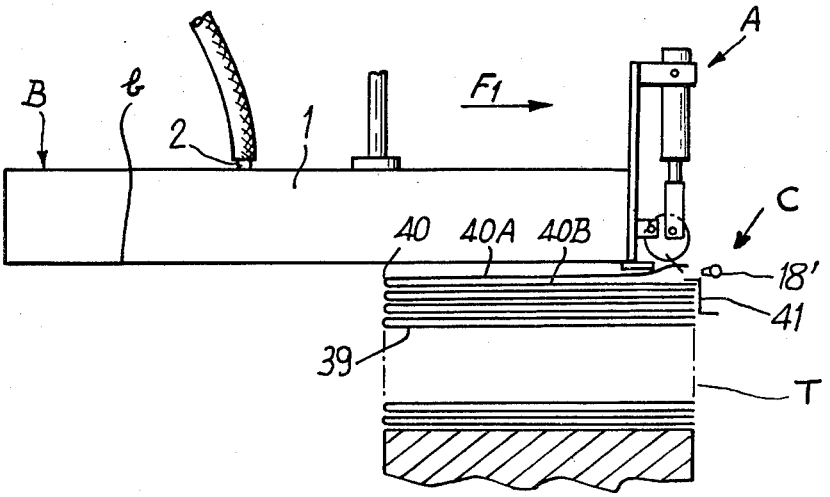
FIG. 9 is a side view analogous to FIGS. 4 and 5 showing the device according to the invention in its second form of embodiment for unfolding and displacing folded and piled articles.

FIGS. 1, 4 and 9 illustrate the combination as a whole, said combination being composed of at least one needle type gripping means A, of a vacuum gripping means B and of a supplying means C acting at a small distance from the adherence surface of the means B between this adherence surface and the first article in the pile.

As the device according to the invention is intended to take and displace knitted articles that may be large in size, it is advantageous to design the vacuum gripping means B in the form of a rectangular vacuum shell 1 connected at 2 to a vacuum source, and having a lower face b comprising numerous adjacent openings and constituting the adherence face, that is to say the face against which an article remains applied owing to the effect of suction when this article has been placed sufficiently close to this face. Preferably, these openings are designed to facilitate their closure, which makes it possible to limit the contour of the effective suction area to match the configuration of the articles to be gripped. Vacuum shell 1 can be displaced vertically by means of a jack 26 and in several horizontal directions (using means that have not been illustrated) since its function is to displace the piled articles.

At one of its extremities, on a small side of the vacuum shell 1, are mounted two needle type gripping means A, spaced apart from one another. If the vacuum shell 1 is very wide, more than two of means A can be used. Each of the needle type gripping means A can be of the type described in French Pat. No. 2 132 573, but it is preferable to use a new type that is more clearly visible in FIG. 2. A vertical plate 3 is provided at its upper extremity with a first yoke 4 between the arms of which is mounted a pneumatic jack 6 oscillating at 5. Close to its lower end, plate 3 is provided with a second yoke 7 between the arms of which a disc 8 is pivotally mounted. The pivot 9 of disc 8 is off-centred in relation to the centre of the disc and its dimensions are such as to allow it to penetrate between the arms of a stirrup 10 attached at the extremity of the piston rod 11 of the jack 6. The disc 8 is articulated at 12 between the branches of the stirrup 10. In this way, the extension and retraction of jack 6 cause alternating oscillation of the disc 8. Said disc has an off-centred hole 13 located close to its outer edge below pivot 9 and, from this hole 13 is bored a channel 14 extending to the outer lateral face of the disc 8 in the vicinity of its lowest point. A needle 16 can be firmly blocked in channel 14 by means of a transverse screw 15. This needle is thus disposed obliquely and its portion projecting outside disc 8 can be precisely adjusted.

Figure 2:
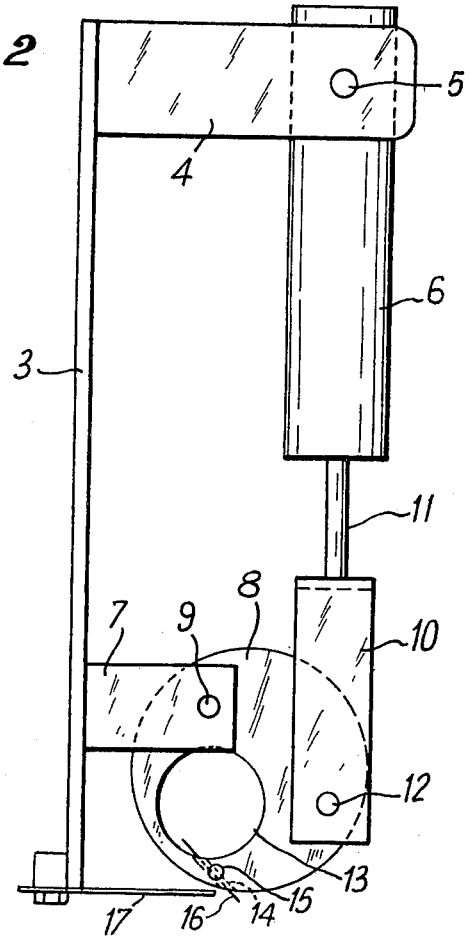
FIG. 2 is a side view in the direction of the arrow f1 of FIG. 1 of a needle type gripping means forming part of the device.

In FIG. 2, the jack 6 is in extended position and the needle 16 is retracted in relation to the lowest point that it can reach. During the retraction of the jack 6, the point of needle 16 describes a circular path about pivot 9 while it descends to a low point, being angled downwards, and then it begins to rise again starting from this point, starting to assume an inverse upwardly orientated angle. This type of movement particularly favours the penetration of the knitted article by the needle, the seizing of said article through its thickness and its attachment for the purpose of being lifted.

The extending movement of the jack 6 causes the needle 16 to move in an opposite direction that tends to detach it from the knitted article.

A plate 17 is attached to the lower end of the support 3 substantially at the height of needle 16 when the latter is in its rest position during the extension movement of the jack 6. The plate 17 extends into the vicinity of the needle 16. During the return stroke of the latter, when the knitted article attached to the needle tends to accompany said needle, it encounters plate 17 which halts its movement; this promotes the detachment of the knitted article.

The supplying means C is constituted by any suitable means whatsoever capable of being placed at a small distance from the adherence face b of the vacuum shell 1. In FIGS. 1 to 4, this means is a rod 18 which extends transversely to the vacuum shell 1 parallel to the adherence face b of the latter. This rod 18 is secured to a carriage 19 having two pairs of upper rollers 20, 21 which roll along a path 22 and a pair of lower rollers 23 which roll underneath said path 22. The path is advantageously constituted by a tube with a square cross-section into which is inserted a piston (not represented). The tubular path 22 is, in fact, the cylinder of a jack the extremities of which are closed by units, 24, 25 respectively, for coupling to a source of compressed-air and to a discharge line. The tubular path 22 is of non-magnetic material and the piston is provided with magnets. In this way, there is a magnetic coupling between this piston and the carriage 19, so that the rod 18 is displaced at the same time as the piston from a point located at the front of or beyond the needle type gripping means A as far as a point located beyond the opposite end of the vacuum shell 1.

Any other suitable known means for displacing the rod 18 could be adopted, just as a movement other than rectilinear could be imparted to it; for example, a quadrant rotating about a vertical shaft could be used to obtain the same desired result.

In the alternative form illustrated by FIGS. 5 to 8, the supplying means C includes an air blowing means 18' closed at one end and connected at the other end to a source of pressurised air via a pipe 17.

Figures 5, 6, 7, 8:
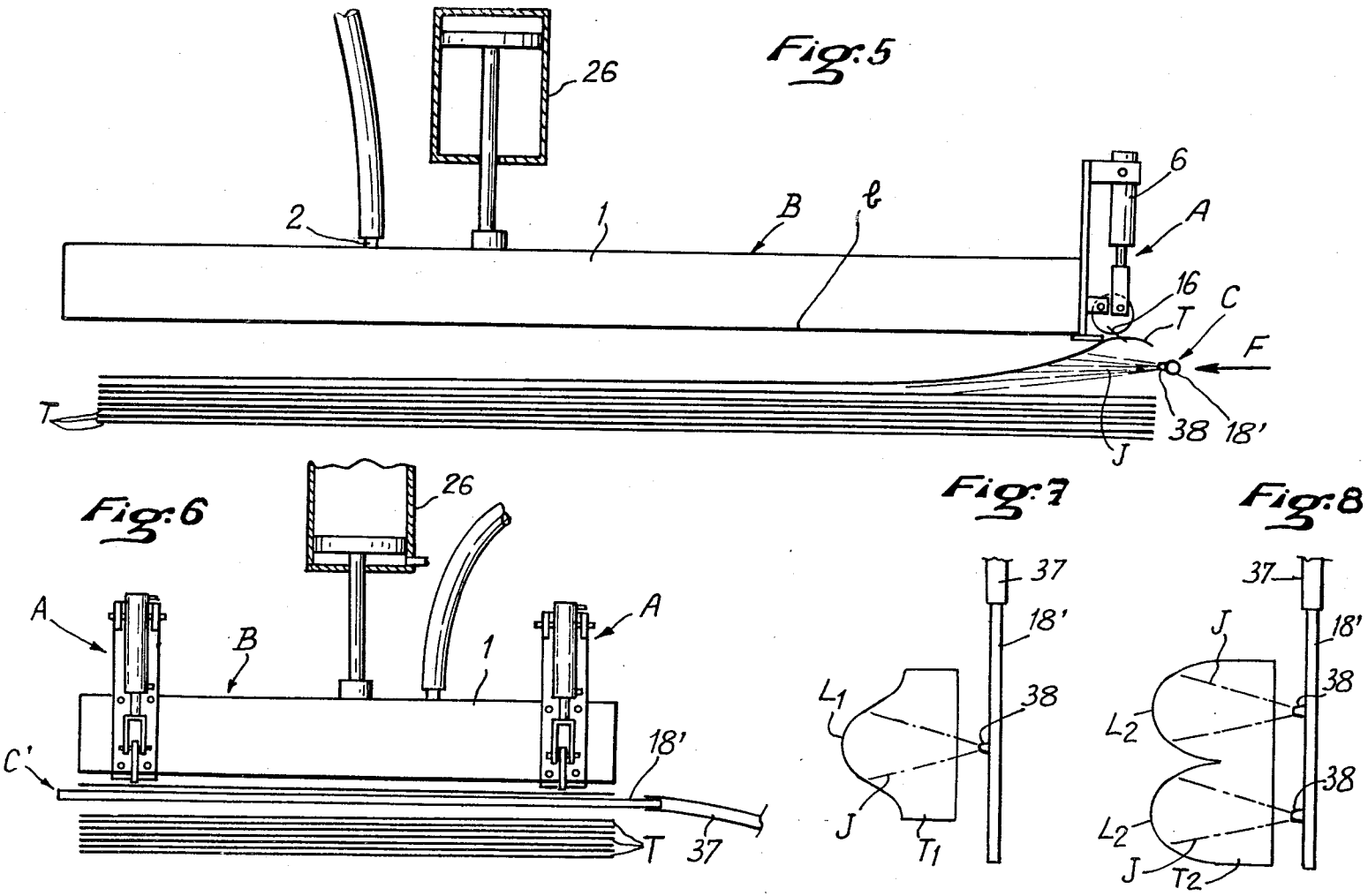
FIG. 5 is a side view of an alternative form of embodiment of the gripping device analogous to FIG. 4.
FIG. 6 is a front view in the direction of arrow F of FIG. 5, analogous to FIG. 3.
FIGS. 7 and 8 are larger scale detailed top views showing the tube and the pressurized air nozzles opposite the profile of the articles to be seized.

Means 18' is located on the same side of the pile of articles T as the gripping means A; it is close to but outside this pile so as not to hinder the lifting of the articles T gripped by the needles 16, as can be seen in FIG. 6. As regards height, the means 18' is located substantially half way between the first article T to be gripped and the lower face of the vacuum shell 1 when the latter is raised to a maximum by the action of the lifting jack 26. Means 18' is parallel to the closest edge of the pile of articles T. It is provided with one nozzle 38 at least and preferably with several nozzles 38 placed at intervals over its length. Each nozzle 38 is directed towards the pile of articles T.

Preferably, when an article T1 (FIG. 8) or T2 (FIG. 9) has points L1 or L2 located at a greater distance from tube 18', nozzles 38 are placed on this tube opposite these points.

It is also preferable for tube 18' to be connected to an air supply that can produce via nozzles 38 air jets the force of which is adjustable and of a pulsatory type.

Tube 18' is fixed. In fact, its location is the same as that of the mobile rod 18 described above when said rod is in its initial position, before it effects its stroke, at the beginning of the operating cycle of the device.

Reference will now be made to FIG. 4 to explain the operation of the device according to the invention.

Knitted articles T have been piled, spread on top of each other for feeding automatically, one by one, to an adjacent machine, for example a sewing machine. The device according to the invention is placed above this pile by means of systems known per se, not represented, so that the adherence face b of the vacuum shell 1 is above the pile as well as the needle type gripping means A. With the jacks 6 of the gripping means A in retracted position, the assembly is lowered over the pile, for example by means of a jack 26 to the piston rod of which the gripping means B and the gripping means A are suspended. At that moment, the jacks 6 are caused to retract. The needles 16 penetrate the thickness of the first article T in the pile; this article is caught up and it is raised at its extremity at the same time as gripping means A and B when the assembly is lifted by causing the jack 26 to retract. In this situation, which is visible in FIG. 4, relative movement is caused between the vacuum gripping means B and the supplying means C. In the present case, the rod 18 is caused to move in the direction of arrow F from the front of the gripping means A, by means of the jack 22 (FIG. 1). To simplify the drawing, only rod 18 has been illustrated in FIG. 4. Rod 18 is engaged under the raised extremity of the first knitted article and during its displacement, it successively conveys each part of this knitted article towards the adherence face of the vacuum shell 1 as far as the latter's suction zone. The vacuum set up in said shell 1 at the same time as the movement of rod 18 causes the knitted article to be sucked against the adherence face b, over its entire surface. There is thus no drooping portion of the knitted article the position of which is therefore precisely known.

In FIG. 4, the intervals have been exaggerated in order to make the drawing clearer; it is obvious that the rod 18 can be guided so as to practically apply the knitted article against the adherence face and so that the adherence caused by the vacuum set up is certain to take place.

When the knitted article has been lifted as we have just explained, the vacuum shell 1 is raised by means of a jack 23 and the assembly is displaced to the desired location, the vacuum in shell 1 is removed and the jacks 6 are caused to extend, with the result that the knitted article drops precisely at the desired point.

It is possible to attach the jack 22, which displaces the means C to the vacuum shell 1, thus providing a device constituting a single unit with the advantage of having a rod that is always located at a suitable distance from the adherence face b of the vacuum shell 1. However, the means C and its jack 22 can be supported close to the pile of articles T independently of the assembly composed of gripping means B and A. For example, this assembly can be guided in a frame for displacement between the point of gripping and the point of depositing; the jack 22 can then be attached to this frame or even constitute a cross-member thereof in relation to the direction of displacement.

With the alternative form illustrated by FIGS. 6 to 9, operation is entirely analogous to that which has just been described.

Figure 3:
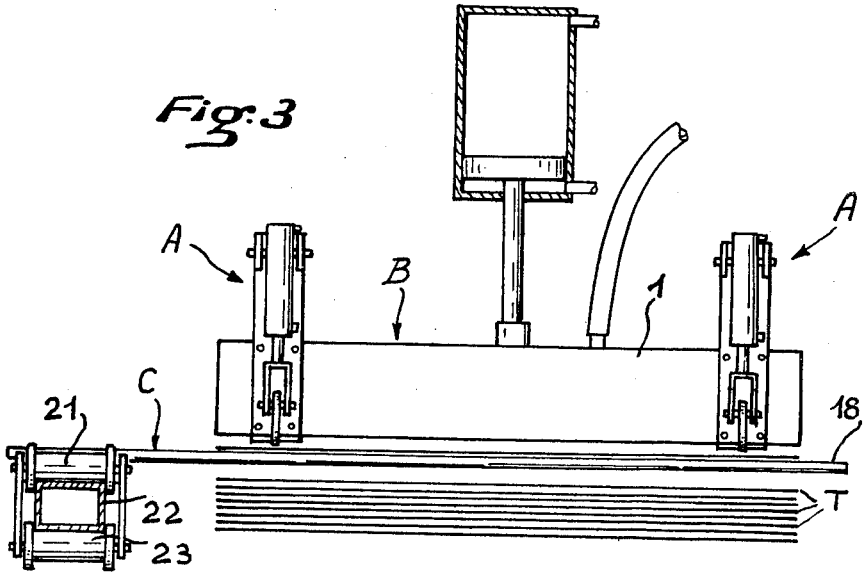
FIG. 3 is a front view in the direction of arrow f3 of FIG. 1 of a part of the device according to the invention.

When the one or more gripping means A have raised, with their needles 16, the end portion close to tube 18' of the first article T in the pile, said tube 18' is supplied with pressurized air at the same time as the vacuum shell is placed in communication with a vacuum source. The air jets J, represented by dot and dash lines in FIGS. 3 and 4, are directed by the nozzles 38 and perform the function of the rod 18 moving along the raised article T, lifting it further over its entire length and conveying it towards the vacuum shell 1 until it is placed in the suction zone of said shell. Experience has shown that the pulsated air jets J give the raised articles T a floating movement which facilitates their lifting over their entire length. This pulsatory movement has to be determined as a function of the nature, the density and the dimensions of the articles T to be raised.

Figure 10:
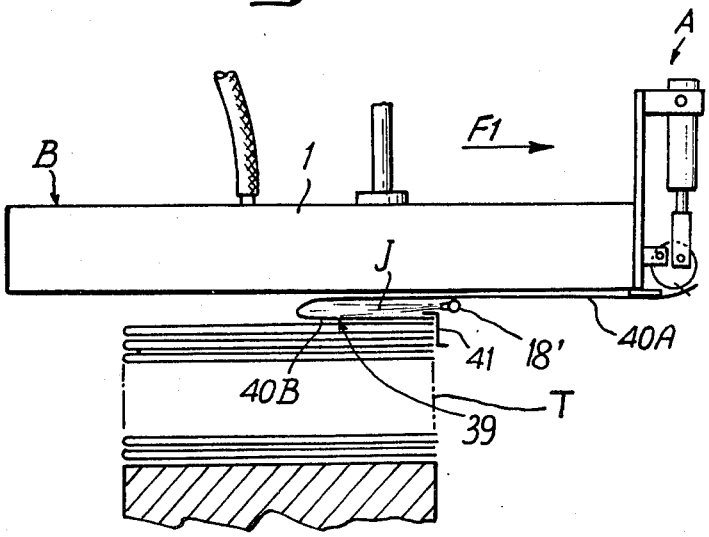
FIG. 10 is a view analogous to that of FIG. 9 representing the device in an intermediate position during its operation.

In FIGS. 9 and 10, the pile T of articles to be gripped is composed of articles 39 that are folded with a fold 40 which creates two superposed panels 40 A and 40 B. The folds 40 are superposed on the same side of the pile T. The tube 18' is located on the side of the pile opposite that of the folds 40 and on the same side of said pile as the gripping means A.

In this case, the relative movement between the third means C and the vacuum gripping means B results from the displacement of said means B in the direction of means C, the latter being fixed. The material members are the same as before.

The blowing tube 18' is disposed in the same way as described above and the gripping means A and B are the same as before, except that the assembly composed of the vacuum shell 1 and the needle type gripping means A is supported by means (not illustrated) enabling it to be displaced in the direction of arrow F1, in the direction of, then above and beyond the tube 18'. The latter is fixed in position.

Such a device is capable of gripping, one by one, articles in a pile of stacked articles already placed flat as in the case of FIG. 1, on condition that the air jet J is powerful enough to lift the first article T and to prevent it from rubbing against the second article and disturbing it.

But the device according to FIG. 9 has, in addition, an advantage that is not provided by the form of embodiment in FIG. 1, namely that of enabling folded articles 39 to be gripped one by one. Said articles 39 each have a fold 40 and two panels 40 A and 40 B which cover one another. In the pile, all the folds 40 are superposed on one side and the tube 18' is placed on the opposite side. In a vertical direction, the pipe 18' must be placed in such a way as to be able to direct a jet of air into the opening of the two panels 40 A, 40 B, when the upper panel 40 A has been gripped by the one or several needle type gripping means A, along its free edge close to the tube 18', and slightly raised (FIG. 5).

The device of FIGS. 9 and 10 functions as follows. When the upper panel 40 A has been gripped and raised, pressurised air is discharged by the nozzles of tube 18' and the vacuum shell is displaced towards said tube 18' in the direction of arrow F1. During this movement, the upper part 39 rolls, from the fold 40, over the upper panel of the following article as illustrated in FIG. 6. The air jet J facilitates this rolling operation by keeping the upper panel 40 A and the lower panel 40 B separated. In proportion as the upper panel unfolds and approaches tube 18', the air jet J conveys it towards the suction zone of the vacuum shell 1 against which it is applied by the force of suction. Finally, article 39 unfolds completely by unrolling and its entire surface is applied against the adherence surface of the vacuum shell 1. Since the action of air jet J is applied progressively to the article that moves towards tube 18', it is not necessary for said air jet to be very powerful. It has been found, in practice, that it is possible under certain circumstances, with articles that are fairly light and which handle well, to dispense with the tube 18' and to replace it by a fixed rod 18.

Under other circumstances, on the contrary, we observe a risk of disturbing the upper panel of the second article during the unfolding of the first article. In this case, one more more retaining fingers 41 are used, these bearing upon the free edge of the lower panel 40 B when the upper panel 40A has been lifted by the needle type gripping means A.

Fingers 41 immobilise the edge of the lower panel 40 B for almost the entire duration of the unfolding operation; they are retracted a short time before said edge separates from the pile.

The retaining fingers 41 are known in the art, as are the means used to actuate them; there does not appear to be any need to describe them in detail.

Naturally, when the vacuum gripping means B can be displaced in the direction of tube 18', it is not outside the scope of the invention to provide also for the displacement of the tube 18', at least over a limited distance, in the direction opposed to the movement of means B; in other words, the relative movement defined above between the vacuum shell 1 and the tube 18' can also be obtained by the displacement in opposite directions of both of these members.

In the above description, reference has been made to articles of knitted fabric. It goes without saying that the invention is suitable for gripping and displacing all sheets or pieces that are piled and the permeability of which is such that a fairly high degree of suction, rendered necessary as a result of their permeability, is liable to cause several sheets or pieces that are superposed to be lifted simultaneously.

I claim:

1. A device for gripping one by one from a pile and for displacing knitted or woven articles, including a vacuum gripping means and a needle type gripping means acting together functionally together, wherein said two means are combined with a third, supplying means, the vacuum gripping means having an adherence surface with a first extremity and a second, opposite, extremity, said adherence surface having at least the same area as the said articles, the needle gripping means being placed in the vicinity of the first extremity of the vacuum gripping means so that the vacuum and needle gripping means may be displaced together as they grip one of said knitted or woven articles and the supplying means being placed in the vicinity of the pile of articles substantially at the height of the first article in said pile, at least one of the vacuum gripping means and the supplying means being mounted so as to cause relative movement therebetween, said movement commencing by said two means approaching one another when the needle type gripping means has seized and raised the edge close to the supplying means of the first article lying on the pile of articles.

2. Device according to claim 1, wherein the supplying means includes at least one air jet discharged from an air blowing tube connected to a pressurised air supply and provided over its length with at least one nozzle, said tube being placed in the vicinity of the pile of knitted articles and the nozzle being directed so as to discharge beneath each first article of the pile, raised at one extremity by the needle type gripping means, a jet of air suitable for raising said article and for conveying it towards the vacuum gripping means as far as the suction zone of the adherence surface of said vacuum gripping means.

3. A device according to claim 2, wherein the nozzle or nozzles of the tube are each placed opposite to the point or points at which the articles to be seized have their larger dimension.

4. A device according to claim 2, wherein the air blowing tube is connected to a source of pressurised air suitable for producing pulsed jets of air.

5. A device according to claim 1, wherein the vacuum gripping means is displaceable by a movement beginning by conveying said means towards the supplying means to cause said relative movement when the free edge of the first article of the pile or the free extremity of the upper panel of the first folded article has been lifted by the needle type gripping means.

6. A device according to claim 5, wherein the supplying means includes an air blowing tube connected to a source of pressurised air and blowing air between the upper panel and the lower panel during the displacement of the vacuum gripping means.

7. A device according to claim 5, wherein the supplying means is stationary during the movement of the vacuum gripping means.

8. A device according to claim 1 wherein the area of said adherence surface is substantially the same as that of said articles.

9. A device for gripping one by one from a pile and for displacing knitted or woven articles, including a vacuum gripping means and a needle type gripping means acting together functionally together, wherein said two means are combined with a third, supplying means, the vacuum gripping means having an adherence surface with a first extremity and a second, opposite, extremity, the needle gripping means being placed in the vicinity of the first extremity of the vacuum gripping means and the supplying means being placed in the vicinity of the pile of articles substantially at the height of the first article in said pile, at least one of the vacuum gripping means and the supplying means being mounted so as to cause relative movement therebetween, said movement commencing by said two means approaching one another when the needle type gripping means has seized and raised the edge close to the supplying means of the first article lying on the pile of articles and wherein the supplying means includes a mobile rod supported and guided for displacement, during the gripping of the first article in the pile, between this first article and the adherence surface of the vacuum gripping means, at a small distance from this surface, from a point located forward of the needle type gripping means to beyond the second extremity of the adherence surface in order to cause said relative movement.

10. A device according to claim 9, wherein the mobile rod is mounted on a carriage that can be displaced along a guide path constituted by a cylinder of a double-acting jack containing a piston provided with magnets, the cylinder being of non-magnetic material and a magnetic coupling being provided between the piston and the carriage.

11. A device according to claim 10, wherein the jack serving as a guide path is attached to a vacuum shell of the vacuum gripping means, the path of displacement of the rod being close to the adherence face of the vacuum shell.

* * * * *